US009611991B2

(12) United States Patent
Ladstaetter

(10) Patent No.: US 9,611,991 B2
(45) Date of Patent: Apr. 4, 2017

(54) LIGHT COVER FOR AN ELONGATE ILLUMINATION SYSTEM

(71) Applicant: ZUMTOBEL LIGHTING GMBH, Dornbirn (AT)

(72) Inventor: Gerald Ladstaetter, Klaus (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 14/783,853

(22) PCT Filed: Apr. 24, 2014

(86) PCT No.: PCT/EP2014/058354
§ 371 (c)(1),
(2) Date: Oct. 10, 2015

(87) PCT Pub. No.: WO2014/174019
PCT Pub. Date: Oct. 30, 2014

(65) Prior Publication Data

US 2016/0069521 A1 Mar. 10, 2016

(30) Foreign Application Priority Data

Apr. 24, 2013 (DE) ..... 20 2013 101 775

(51) Int. Cl.
*F21S 8/00* (2006.01)
*F21S 8/02* (2006.01)
(Continued)

(52) U.S. Cl.
CPC ..... *F21S 8/026* (2013.01); *F21S 8/04* (2013.01); *F21V 3/04* (2013.01); *F21V 3/049* (2013.01);
(Continued)

(58) Field of Classification Search
CPC .... F21S 8/026; F21S 8/04; F21V 3/04; F21V 3/0445; F21V 3/049; F21V 17/164
See application file for complete search history.

(56) References Cited

U.S. PATENT DOCUMENTS 4,138,716 A * 2/1979 Muhlethaler ..... F21S 8/06 362/260
5,902,035 A 5/1999 Mui

FOREIGN PATENT DOCUMENTS

DE 1489335 4/1969
DE 202009015404 9/2010
(Continued)

OTHER PUBLICATIONS

International Search Report for PCT/EP2014/058354, English translation attached to original, Both completed by the European Patent Office on Jul. 7, 2014, Mailed Jul. 14, 2014, All together 7 Pages.

*Primary Examiner* — Thomas M Sember
(74) *Attorney, Agent, or Firm* — Brooks Kushman P.C.

(57) ABSTRACT

A light cover for an elongate illumination system has a substantially planar, elongate light-emitting element and securing strips provided on the longitudinal sides of the light-emitting element, the securing strips being provided for securing the light cover to a light housing. The light-emitting element and the securing strips are made of different materials and the material of the securing strips is more flexible than the material of the light-emitting element.

10 Claims, 3 Drawing Sheets

(51) Int. Cl.

| | |
|---|---|
| ***F21S 8/04*** | (2006.01) |
| ***F21V 3/04*** | (2006.01) |
| ***F21V 17/16*** | (2006.01) |
| *F21Y 103/00* | (2016.01) |

(52) U.S. Cl.
CPC ..... *F21V 3/0445* (2013.01); *F21V 17/164* (2013.01); *F21Y 2103/00* (2013.01)

(56) References Cited

FOREIGN PATENT DOCUMENTS

| | | |
|---|---|---|
| DE | 202012102874 | 4/2013 |
| DE | 202012101239 | 7/2013 |
| EP | 0669492 | 8/1995 |
| EP | 2042802 | 4/2009 |
| EP | 2239498 | 10/2010 |
| EP | 2484961 | 8/2012 |
| EP | 2642193 | 9/2013 |

* cited by examiner

LIGHT COVER FOR AN ELONGATE ILLUMINATION SYSTEM

CROSS-REFERENCE TO RELATED APPLICATION

This application is the U.S. national phase of PCT Application No. PCT/EP2014/058354 filed on Apr. 24, 2014, which claims priority to DE Patent Application No. 20 2013 101 775.2 filed on Apr. 24, 2013, the disclosures of which are incorporated in their entirety by reference herein.

The present invention relates to a light cover, which is provided for use in an elongate illumination system, in particular in so-called light bands.

A light band is understood as an illumination system which extends continuously over a very great length in comparison to individual lights. Such light bands can be used both as recessed variants and also in the form of add-on lights or suspended lights. They generally have a carrier element extending over the entire length of the system, which consists of multiple segments or modules and is used both for mounting or arranging on or in the ceiling and also for retaining all essential components for light emission. In general, such carrier elements are embodied as U-shaped, wherein the longitudinal channel formed for this purpose is used for accommodating the light sources and the operating devices required for operating the light sources. The lower side of the channel is then closed by a cover, which forms the light emission surface of the light band and has appropriate optical properties to implement the light emission in the desired manner. In this case, the cover can both be formed as light-scattering and can also contain components, with the aid of which the light is emitted in a targeted manner in specific angle ranges.

However, the problem exists with respect to the mentioned cover that the corresponding elements can realistically only be produced up to a specific length. They are typically elements made of plastic, which are produced in the injection-molding method or in the extrusion method and have a very low flexibility in any case. They are therefore typically produced in specific standard lengths, wherein a corresponding light band can extend over a significantly greater length, however. In this case, multiple such covers must then be concatenated, which has the result that butt joints arise in the light exit region at the transition regions between two adjacent covers, which can have a negative effect on the light emission. The attempt has been made to counteract this by forming the end sides of the covers such that they interlock in a slightly overlapping manner, in spite of this, however, light beams exiting in this transition region are necessarily influenced somewhat differently, so that such butt joints are still at least easily recognizable. This is also to be attributed to the fact, inter alia, that in the event of temperature variations, the covers expand differently in comparison to the housing, which consists of metal, and can accordingly be displaced in relation to one another relatively easily during operation, so that the butt joints are still more clearly recognizable in specific situations.

It would be theoretically conceivable to produce covers integrally, which extend over the entire length of the light band. However, the problem then arises that covers which are multiple meters long can only be transported with difficulty to the final usage location.

The present invention is therefore based on the object of providing a novel solution for implementing a corresponding light cover for the above-described elongate illumination systems, in which, on the one hand, the mentioned problems are avoided and, on the other hand, the quality of the light emission meets the highest demands with the aid of the light emission element.

The object is achieved by a light cover, which has the features of claim 1. Advantageous refinements of the invention are the subject matter of the dependent claims.

The solution according to the invention is based on the idea of forming the cover integrally over the entire length of the light band, but using different materials for various regions or components of the cover. It is thus provided in particular that the cover consists of an elongate, plate-shaped light emission element, which is formed as essentially level. In contrast, fastening profiles are arranged on both longitudinal sides of the light emission element, with the aid of which fastening on the light housing is performed. According to the invention, for this purpose the fastening profiles are formed from a material which is more flexible than the material of the light emission element.

Accordingly, a light cover for an elongate illumination system is proposed according to the invention, which comprises an essentially plate-shaped, elongate light emission element and also fastening profiles, which are arranged on the longitudinal sides of the light emission element and which are provided for fastening the light cover on a light housing, wherein the light emission element and the fastening profiles consist of different materials and the material of the fastening profiles is more flexible than the material of the light emission element.

The solution according to the invention enables the light cover according to the invention to be produced in arbitrary lengths, in particular also as endless. The decisive advantage is, however, that because of the plate shape of the light emission element and the different material selection for the components of the light cover, the possibility exists of bending the cover at least to a certain degree and therefore also rolling it up. In the rolled-up state, even an extremely long light cover can be transported in a simple manner to the usage location and shortened there to the required length if necessary. In this way, the possibility is opened up of implementing an integral light cover extending over the entire length of the light band. At the same time, a material can be selected for the light emission element which meets the optical requirements with respect to high-quality light emission.

The fastening profiles preferably extend over the entire length of the light emission element. For this purpose, they can each form one or more webs, which are aligned essentially perpendicularly to the plane of the light emission element. Even in this configuration, the above-described rolling up of the light cover is still enabled, since the flexibility of the material for the fastening profiles enables this. In contrast, if the fastening profiles were formed from a rigid material or from the material of the light emission element, corresponding rolling up of the cover would thus be impossible and the problem would again exist that the cover can only be transported in the extended state, which is nearly impossible from specific lengths—as already mentioned above.

PMMA or PC or another material, which has suitable optical properties and provides the light emission element with a specific intrinsic stability, is preferably used as the material for the optically active hard component, i.e., for the light emission element. PMMA and PC are materials which are often used in illumination technology for implementing light emission elements. In any case, these materials enable the implementation of a light emission element which has the desired optical properties. In contrast, a thermoplastic elastomer, the optical properties of which are unimportant for the light cover, is preferably used as the soft component for the fastening profiles. However, this material is sufficiently flexible at the same time to enable the rolling up of the cover.

The use of a more flexible material for the fastening profiles furthermore also provides the advantage that—for the case that the fastening profiles extend over the entire length—a very good seal can be achieved between cover and light housing. This also has the result that with the aid of the cover, the penetration of dirt, dust, or moisture into the interior of the light band is reliably prevented. Very stable retention on the light housing is simultaneously ensured, which is relevant insofar as after the unrolling of the cover, it is possibly still slightly curved and the corresponding forces between light housing and fastening profiles must ensure that the cover can be aligned continuously linearly as desired or can be arranged resting on the housing.

According to one refinement of the invention, the light emission element can be provided with a light-influencing structure in this case. This can be formed, for example, by a glued-on film.

The invention will be explained in greater detail hereafter on the basis of the appended drawings. In the figures:

FIG. 1 schematically shows a view of a light band system;

Figure 1:
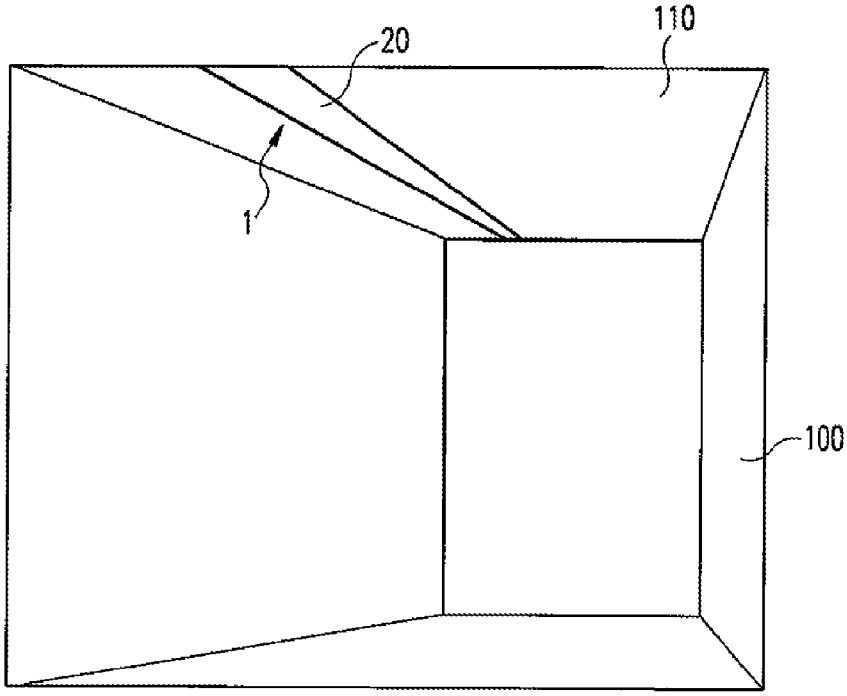

FIG. 1 shows a typical application of a light band, in which the light cover according to the invention is used. The light band, which is provided with the reference sign 1, is provided here as a recessed variant and is used to illuminate an elongate room 100, for example, a hallway, over its entire length. Because of the ceiling installation, only the lower side of the light band system 1 is recognizable. More precisely, exclusively the elongate light cover 20 is visible to an observer, via which light is emitted toward the lower side. The light cover 20 can influence the light upon emission in a suitable manner as needed for this purpose, either to emit light in a very broad angle range and/or diffusely or to emit light in a targeted manner in specific directions. The condition for this is that the material of the cover 20 has corresponding optical properties, which limits the possibilities for the selection of a suitable material.

Figure 2:
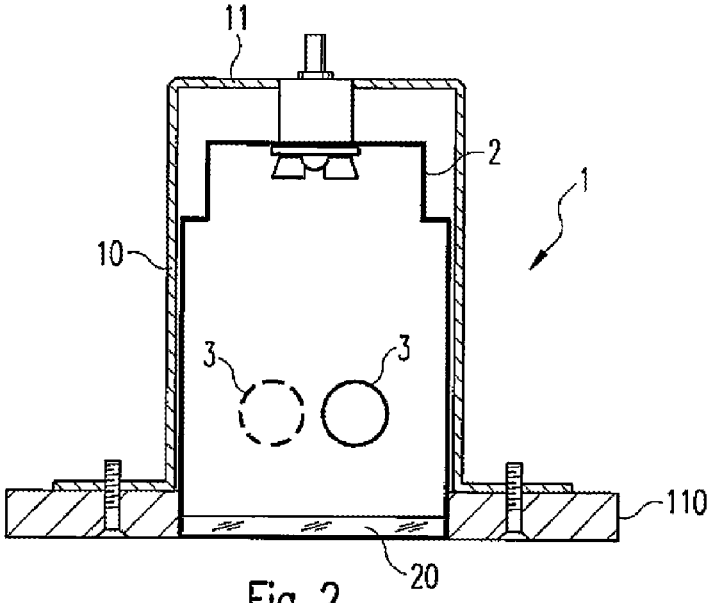
FIG. 2 shows a cross-sectional illustration of the light band system from FIG. 1.

A fundamental construction of a light band system 1 is shown in a sectional illustration in FIG. 2. The main component is an elongate housing 2, which is used to accommodate all important components. In the present case, only two light sources 3, which are located in the interior of the light housing 2, are schematically shown. In addition, the elongate receptacle space of the approximately U-shaped housing 2 is also used to mount suitable operating devices for operating the light sources 3 and also the lines for the power supply. In the present case, fluorescent lamps 3 are shown as light sources, which are arranged one behind another over the entire length of the light band system 1, to emit light over the entire length. However, other light sources, in particular LEDs, could also be used. On the lower side, the housing 2 is then closed by the light cover 20, wherein the embodiment of this cover 20 and the fastening thereof on the housing 2 will be explained in greater detail hereafter. For visual reasons, the arrangement of the cover 20 on the housing 2 is performed in this case such that the cover 20 terminates flush with the lower side of the ceiling 110 of the room 100. The mounting of the entire system 1 is performed with the aid of mounting brackets 10, which are screwed onto the ceiling on one side and are coupled on the middle leg 11 thereof to the housing 2 of the light band 1 on the other side.

The housing structure 2 of the light band 1 is typically formed from multiple segments or units which are connectable to one another. In this way, light bands having a nearly arbitrary length may be implemented, wherein a corresponding number of segments or units merely has to be joined together or arranged one after another. The modular construction of the housing 2 does not have a negative effect in this case on the appearance of the light band 1, since only the light cover 20 is visible to an observer in any case in the illustrated exemplary embodiment.

However, the above statements do not apply for the light cover 20, i.e., a modular construction of the cover 20 over the entire length results in a significant impairment of the appearance of the light band system 1, since in particular in the activated state of the light sources 3, the butt joints between two adjacent cover elements would be visible.

A light cover is now provided by the solution according to the invention, which can be implemented as nearly endless, but in particular can be adapted in an arbitrary manner to the length of the light band system 1. The light cover 20 is embodied in this case such that it can not only be produced comparatively simply, but rather it can also additionally be transported without great effort to the usage location. At the same time, the cover meets the requirements with respect to the materials used in regard to the desired light emission of a light band system 1.

Figure 3:
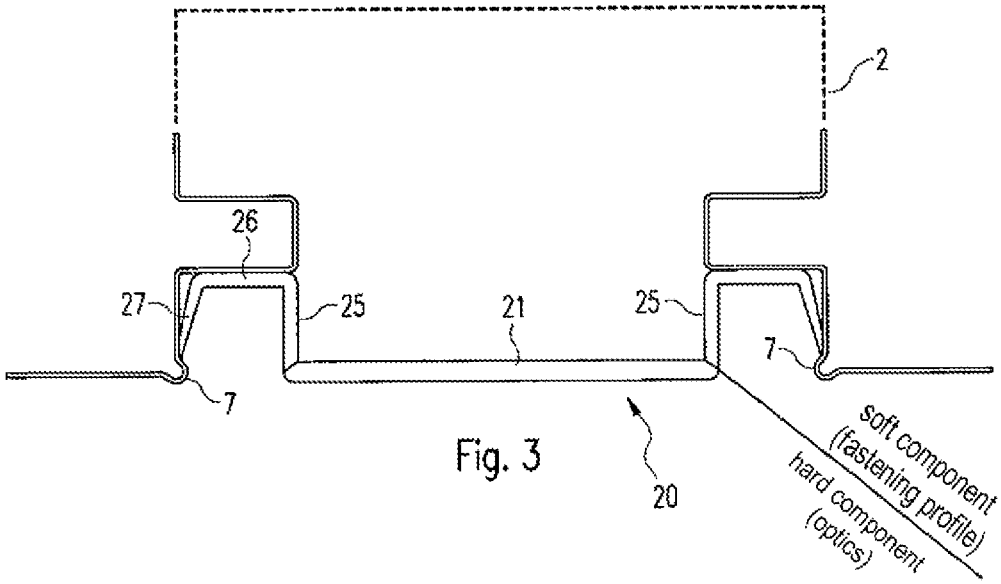
FIG. 3 shows the embodiment of the light cover according to the invention in an enlarged illustration

The embodiment according to the invention of the light cover 20 is shown in FIG. 3, wherein the housing 2, in particular the lower end region thereof, and the cover 20 fastened on the housing 2 are schematically shown here. The cover 20 itself consists in this case of two different components, on the one hand, the elongate light exit element 21, via which the light emission of the light band 1 occurs, and, on the other hand, two fastening profiles 25 arranged on both sides of the emission element 21. As is recognizable, these fastening profiles 25 are used for fastening the cover 20 on the housing 2. They have a U shape for this purpose, wherein the middle leg 26 and the outer lateral legs 27 are each provided for latching or clamping with the lower profiled region of the light housing 2. More precisely, in this case the outer lateral leg 27 is clamped with a slight projection 7 of the housing 2 or a corresponding undercut, wherein the embodiment of the housing 2 and the embodiment of the fastening profiles 25 could optionally also be selected differently, as will also be shown hereafter on the basis of a variant according to the invention.

It is provided according to the invention that the two components—light emission element 21 and fastening profile 25—consist of different materials. In particular, a material which is suitable for a corresponding influence of the light emission is selected for the optically active light emission element 21. For example, PMMA or PC come into consideration for this purpose. Other materials would also be conceivable, if they result in a certain intrinsic stability of the light emission element formed therefrom. At the same time, the light emission element 21 is flexible because of the plate shape, i.e., it can be at least slightly bent in two dimensions which—as explained in greater detail hereafter—is essential for the optimum transportation properties of the light cover 20 according to the invention.

In contrast, the material of the fastening profile 25 is significantly more flexible than the material for the light emission element 21, wherein a thermoplastic elastomer is preferably used. This increased flexibility in the fastening profiles 25 is accompanied by the advantage, on the one hand, that simpler fastening of the cover 20 on the housing 20 is enabled and at the same time also—for the advantageous case that the fastening profiles 25 extend completely over the entire length of the light cover 20—an optimum seal is achieved between the housing 2 and the cover 20, so that the penetration of dirt or moisture at the interface is avoided. In this way, the possibility exists of implementing light designs of so-called higher protection class with the aid of the cover according to the invention.

Figure 4:
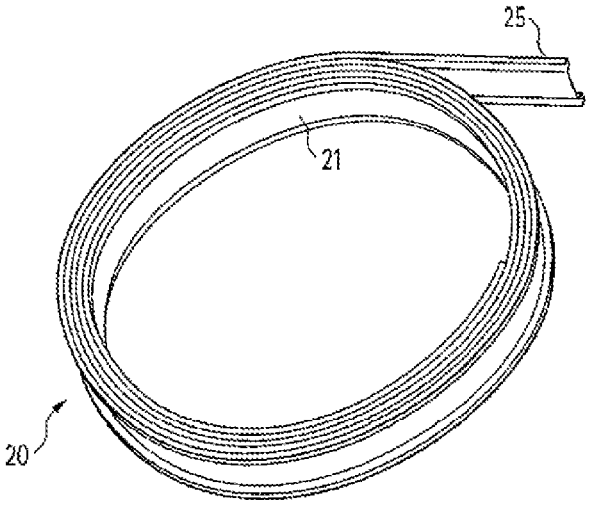
FIG. 4 shows the light cover according to the invention in the rolled-up state.

Furthermore, the flexibility of the fastening profiles 20 enables them to be bent comparatively easily in spite of the fact that they have multiple legs oriented differently in relation to one another, which are in particular also aligned perpendicularly to the plane of the light exit element 21. The unit consisting of the hard component, i.e., the light emission element 21, and the soft component, i.e., the fastening profiles 25, can therefore be rolled up, as shown in FIG. 4. Obviously, a light cover of nearly arbitrary length can be brought into a form in this manner in which it can be easily transported, in particular can be transported to the usage location, i.e., the installation location of the light band system 1.

As can be inferred in this case from the illustration of FIG. 4, in this case, the lateral faces of the roll are formed by the fastening profiles consisting of the more flexible material. In this case, these also simultaneously form a protection of the light emission element relevant for the light emission since, on the one hand, a mechanical protection from external influences is achieved and, on the other hand, the penetration of dust or dirt into the intermediate spaces of the roll is also prevented. Furthermore, in the rolled-up state, the fastening profiles fulfill the function of spacers, by which the rolled-up layers of the light emission element are prevented from lying one on top of another, whereby the risk of damage during the transport is additionally also reduced.

Furthermore, it is to be noted in this context that the light emission element 21 does not necessarily have to be embodied as completely level or planar, but rather can certainly also have a specific profile, for example, a slight bulge or the like. It is only essential that the bending capability is not impaired excessively strongly by this profiling or shaping, so that the cover can still be rolled up in the meaning of the present invention.

Finally, it is thus provided that the light cover 20 is transported in the rolled-up state to the usage location and then cut to the required length if needed here, which corresponds to the length of the light band system 1. The cover 20 can then be fastened in a simple manner on the lower side of the light housing 2, so that a cover extending integrally over the entire length is provided. It is also particularly advantageous for this purpose if the fastening profiles 25 extend completely over the entire length, since a fastening of the cover 20 is achieved at every point of the housing. This is relevant insofar as after unrolling of the cover 20, it can possibly still be slightly curved and the tension still remaining is absorbed with the aid of the fastening profiles 25, so that the cover 20 presses as desired linearly against the housing 2 and therefore flush with the ceiling lower side.

During the operation of the light band system 1, the cover 20 can contract or expand slightly in comparison to the housing 2 as a result of temperature variations. Therefore, corresponding measures have to be taken at the end regions of the light band system, to absorb these length variations and to avoid the occurrence of gaps or the like, which impair the light emission. Such gaps or disturbances in the light emission are now no longer a concern in the remaining region of the light band as a result of the integral nature of the cover, however.

Production of the light cover 20 according to the invention is preferably performed in the so-called coextrusion method. In this way, the cover can initially be produced in nearly endless length.

In a refinement of the invention, it can furthermore be provided that the light exit element—both on its light exit side and also on the opposing light entry side—has a certain structuring, by which the light emission is influenced in a specific desired manner. For example, in the scope of the above-mentioned extrusion method, elongate structures, for example, elongate prisms or channels, can certainly be introduced into the surface of the light exit element. If transverse structures are optionally also to be implemented, it would thus be possible, for example, to form them with the aid of a film, which is glued onto the light exit element, for example.

Figure 5:
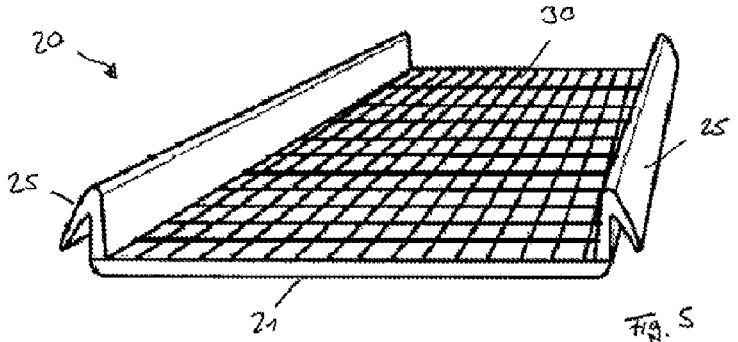
FIGS. 5 and 6 show views of a further exemplary embodiment of a light cover according to the invention.
Figure 6:
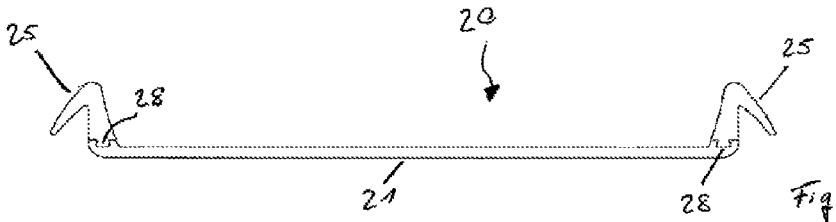

FIGS. 5 and 6 show, as a further exemplary embodiment, a corresponding light cover 20, in which the surface of the light exit element 21 facing toward the light housing is provided with a corresponding structure 30. This indicated structure 30 consists in the illustrated case of structure elements crossing one another. Since such a structure is difficult to implement in the scope of an extrusion method, the structure is therefore preferably formed by a film in the illustrated case, which was glued onto the corresponding side of the light exit element 21. However, the light cover 20 according to the invention can in turn also be rolled up as a whole to form the roll shown in FIG. 4.

Figure 7:
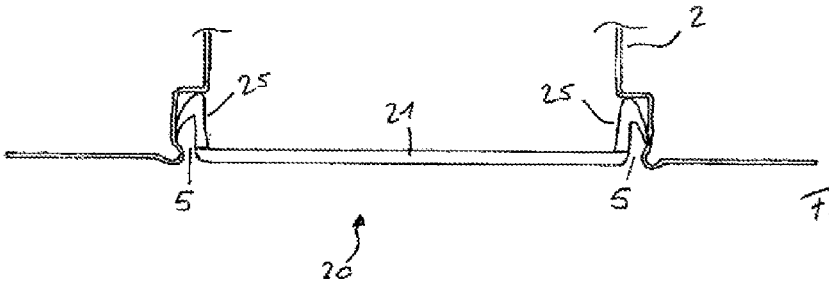
FIG. 7 shows the arrangement of the light cover of FIGS. 5 and 6 on a light housing.

In this second exemplary embodiment, the lateral fastening profiles 25 are also embodied somewhat differently and now approximately have a V shape in cross section. This shape also enables rolling up of the light cover 20, on the one hand, and enables fastening on a light housing, on the other hand, as shown in FIG. 7. Narrower shadow joints 5 are formed for this purpose on both sides of the cover than is the case in the exemplary embodiment of FIGS. 1 to 4.

The cross-sectional illustration of FIG. 6 also shows a particularly advantageous embodiment of the light exit element 21 and of the fastening profiles 25 in the connection region in this case. Because one of the two components—the fastening profiles 25 here—has a web having 28 undercuts, which is enclosed by the other components, a particularly good connection is achieved, by which permanent cohesion is ensured in spite of the different materials. Of course, this formation could also be provided in the embodiment of FIGS. 1 to 4.

Finally, a light cover is thus provided by the invention, which can be adapted in a simple manner to arbitrary lengths of a light band system. The transport of the cover to the usage location thereof also no longer represents a problem for this purpose as a result of the material selection according to the invention. It is ensured at the same time, however, that materials are used for the optically relevant components which meet the corresponding requirements. In this case, the use of the cover according to the invention is not restricted to recessed variants. It can also be used in add-on variants or suspended light bands, of course.

The invention claimed is:

1. A light cover for an elongate illumination system, comprising:

an essentially planar plate-shaped, elongate light emission element; and fastening profiles, which are arranged on longitudinal sides of the light emission element for fastening the light cover on a light housing said fastening profiles being integrally formed with the light emission element;

wherein the light emission element and the fastening profiles consist of different materials and the material of the fastening profiles is more flexible than the material of the light emission element.

2. The light cover as claimed in claim 1, wherein the fastening profiles extend over the entire length of the light emission element.

3. The light cover as claimed in claim 1, wherein the fastening profiles each form one or more webs, which are at least partially aligned essentially perpendicularly to the plane of the light emission element.

4. The light cover as claimed in claim 1, wherein the light emission element consists of PMMA or PC.

5. The light cover as claimed in claim 1, wherein the fastening profiles consist of a thermoplastic elastomer.

6. The light cover as claimed in claim 1, wherein the light emission element has light-scattering properties.

7. The light cover as claimed in claim 1, produced by a coextrusion method.

8. The light cover as claimed in claim 1, wherein at least one surface of the light emission element is provided with a structure.

9. The light cover as claimed in claim 8, wherein the structure is formed by a film, which is glued onto the light emission element.

10. The light band system comprising:

an elongate housing having light sources located therein, and a light cover as claimed in claim 1.

* * * * *